US011583152B2

(12) United States Patent
Hackert et al.

(10) Patent No.: US 11,583,152 B2
(45) Date of Patent: Feb. 21, 2023

(54) METHOD OF OPERATING A CLEANING SYSTEM, BASE STATION AND FILTER APPARATUS

(71) Applicant: Vorwerk & Co. Interholding GmbH, Wuppertal (DE)

(72) Inventors: Georg Hackert, Bochum (DE); Uwe Kemker, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 272 days.

(21) Appl. No.: 16/846,560

(22) Filed: Apr. 13, 2020

(65) Prior Publication Data

US 2020/0329933 A1 Oct. 22, 2020

(30) Foreign Application Priority Data

Apr. 18, 2019 (EP) ..... 19170267

(51) Int. Cl.
*A47L 9/14* (2006.01)
*A47L 7/00* (2006.01)

(52) U.S. Cl.
CPC ..... *A47L 9/1454* (2013.01); *A47L 7/0038* (2013.01); *A47L 2201/024* (2013.01)

(58) Field of Classification Search
CPC ..... A47L 2201/024; A47L 2201/026; A47L 7/0038; A47L 2201/02
See application file for complete search history.

(56) References Cited

U.S. PATENT DOCUMENTS

| | | | | |
|---|---|---|---|---|
| 9,808,135 | B2 | 11/2017 | Mantyla et al. | |
| 10,709,308 | B2 | 7/2020 | Buehler et al. | |
| 2009/0044370 | A1* | 2/2009 | Won | A47L 11/4008 15/319 |
| 2009/0049640 | A1 | 2/2009 | Lee et al. | |
| 2012/0013907 | A1 | 1/2012 | Jung et al. | |
| 2015/0198952 | A1 | 7/2015 | Einecke et al. | |
| 2017/0164800 | A1 | 6/2017 | Arakawa | |
| 2018/0125312 | A1* | 5/2018 | Kuhe | A47L 5/24 |
| 2018/0125314 | A1 | 5/2018 | Kim et al. | |
| 2018/0304462 | A1 | 10/2018 | Li | |
| 2018/0360282 | A1 | 12/2018 | Erkek et al. | |
| 2019/0090701 | A1* | 3/2019 | Tonderys | A47L 9/2884 |
| 2019/0274506 | A1 | 9/2019 | Kim et al. | |

FOREIGN PATENT DOCUMENTS

| | | | |
|---|---|---|---|
| CN | 1889881 | A | 1/2007 |
| CN | 108403017 | A | 8/2018 |
| CN | 208211982 | U | 12/2018 |

(Continued)

*Primary Examiner* — Bryan R Muller
(74) *Attorney, Agent, or Firm* — Jason H. Vick; Sheridan Ross, PC

(57) ABSTRACT

A method for operating a cleaning system with a plurality of mobile cleaning devices and a base station for the cleaning devices as well as a base station for a plurality of mobile cleaning devices are proposed, wherein the cleaning devices can be emptied by the base station and/or filled with a cleaning agent by the base station simultaneously and/or according to a prioritization. In addition, a filter apparatus for a base station is proposed which has a plurality of connection openings in order to be able to empty a plurality of cleaning devices.

18 Claims, 3 Drawing Sheets

(56) References Cited

FOREIGN PATENT DOCUMENTS

| | | | | | |
|---|---|---|---|---|---|
| CN | 208274537 | U | | 12/2018 | |
| CN | 109124490 | A | | 1/2019 | |
| DE | 102011054162 | A1 | | 4/2013 | |
| DE | 102019004417 | A1 | * | 12/2020 | ..... G01F 23/14 |
| EP | 3033982 | A1 | * | 6/2016 | ..... A47L 5/38 |
| EP | 3033982 | A1 | | 6/2016 | |
| EP | 3033983 | A1 | * | 6/2016 | ..... A47L 5/12 |
| KR | 101467341 | B1 | * | 12/2014 | ..... A47L 9/106 |
| KR | 20220136483 | A | * | 10/2022 | ..... A47L 9/2884 |

* cited by examiner

METHOD OF OPERATING A CLEANING SYSTEM, BASE STATION AND FILTER APPARATUS

CROSS-REFERENCE TO RELATED APPLICATIONS

This application claims the benefit under 35 U.S.C. 119(a) to European Patent Application No. 19 170 267.9, filed Apr. 18, 2019, the disclosure of which is incorporated herein by reference in its entirety.

SUMMARY

The present technology relates to a method of operating a cleaning system according to the preamble of claim 1, a base station for a cleaning device according to the preamble of claim 8, and a filter apparatus for a base station according to the preamble of claim 12.

A base station in accordance with one aspect of the technology is a structural, preferably stationary, device for servicing/maintaining a (mobile) cleaning device, in particular for emptying or sucking out a collection container of the cleaning device.

EP 3 033 982 A1 discloses a base station for cleaning and/or emptying a hand vacuum cleaner, wherein the base station can be connected to an optional adapter module in order to connect a cleaning robot to the base station in addition to the hand vacuum cleaner.

One exemplary aspect of the present technology is to provide an improved method for operating a cleaning system, an improved base station for fluidic connection of a plurality of cleaning devices, as well as an improved filter apparatus for a base station, whereby a fast, flexible, energy-efficient and/or user-friendly maintenance of the cleaning devices is enabled or supported. In particular, the base station shall have a simple, robust and/or compact construction.

One problem underlying the current technology is solved by a method according to the claims herein. Advantageous developments are the subject of the sub-claims.

A cleaning system in the sense of the present technology is a system with a plurality of components for cleaning surfaces, in particular floors, indoors and/or outdoors. Such a cleaning system comprises at least one, preferably a plurality of, (mobile) cleaning devices and a preferably stationary base station for maintenance of the cleaning devices. The cleaning devices are connected to the base station after use or after a cleaning process in order to preferably automatically or in a self-acting manner (electrically) charge and/or preferably automatically or in a self-acting manner empty or suck out the cleaning devices.

A cleaning device in the sense of the present technology is preferably a handheld vacuum cleaner, an in particular movable floor vacuum cleaner, a vacuum cleaner with snout, or a rod/stick vacuum cleaner, or a (partially) autonomous or self-driving or self-flying robotic vacuum cleaner, hereinafter referred to as cleaning robot.

However, a cleaning device within the sense of the present technology may also be any other device for cleaning and/or maintaining surfaces, in particular floors. For example, floor wiping devices or robots, polishing devices or robots, window cleaning devices or robots or lawn mowing devices or robots are also to be understood as cleaning devices within the sense of the present technology.

According to one aspect of the present technology, a plurality of cleaning devices are maintained at the same time/simultaneously by means of the base station, in particular emptied or sucked out and/or filled with a cleaning agent, particularly preferably automatically or in a self-acting manner.

The proposed base station is therefore designed for maintaining, in particular emptying/sucking out and/or filling, of the cleaning devices simultaneously/at the same time.

The expression "sucking out" a cleaning device or a container preferably is to be understood as removing or withdrawing material contained in the cleaning device or container by suction. In other words, material is sucked off or drawn out of the cleaning device or container, or the cleaning device or container is emptied or evacuated.

The material contained in the cleaning device or container is in particular vacuumed material, such as dust, which was received by the cleaning device or container in a cleaning process, for example when vacuuming the floor with the cleaning device.

Preferably, the base station has a working machine, in particular a blower/fan and/or pump, and a container to simultaneously suck vacuumed material out of the cleaning devices and/or pump a cleaning agent into the cleaning devices.

In this way, a particularly fast and/or efficient maintenance of the cleaning devices is made possible and the availability of the cleaning devices is increased.

According to a further aspect of the present technology, which can also be realized independently, the cleaning devices are maintained by the base station and/or automatically/in a self-acting manner, in particular emptied/sucked out and/or filled and/or electrically charged, according to a—in particular predefined or electronically stored—prioritization.

Preferably, a first, in particular (partially) autonomous and/or self-driving or self-flying cleaning device, such as a cleaning robot, is emptied or sucked out and/or filled by the base station subordinated/secondary and/or a second, in particular hand-guided, cleaning device is emptied or sucked out and/or filled by the base station with priority/primary.

For example, it may be intended to interrupt emptying/sucking out and/or filling of the first cleaning device when the second cleaning device is connected to the base station (fluidically). In addition, or alternatively, it may be provided to—automatically/in a self-acting manner—start emptying/sucking out and/or filling the first cleaning device only after the second cleaning device is fully charged, emptied/sucked out and/or filled or used by a user.

The prioritization increases the availability of the prioritized cleaning device, in particular a handheld cleaning device, and thus the user-friendliness.

In a particularly preferred method variant, the cleaning devices are emptied/sucked out and/or filled selectively either one after the other/according to a prioritization or simultaneously/at the same time.

The base station preferably has a control device and a shut-off apparatus, such as a shut-off flap or butterfly valve, which is in particular controlled or connected to the control device, in order to selectively connect the first cleaning device, the second cleaning device and/or both cleaning devices fluidically to the base station or the container of the base station.

The cleaning devices are preferably emptied and/or filled with a cleaning agent simultaneously or according to a prioritization with the shut-off apparatus being in an end position and/or in a defined switching status.

The proposed filter apparatus for the base station preferably has a plurality of connection openings for filling the filter. Preferably the filter apparatus has a first connection opening for the first cleaning device and a second (separate) connection opening for the second cleaning device. In this way it is possible to use the filter apparatus at the same time/simultaneously for a plurality of cleaning devices or fluidic connections and/or to fill the filter apparatus from different sides.

A filter apparatus in the sense of the present technology is an apparatus for filtering a fluid, in particular air, preferably to separate particles from the fluid. Preferably, a filter apparatus in the sense of the present technology is a single-use or disposable article. For example, a filter apparatus in the sense of the present technology can be designed as a filter bag or filter cartridge.

The proposed filter apparatus is preferably designed to be extendable or expandable and has—at least in the expanded state—an elongated, in particular cylinder-like shape.

The connection openings of the filter apparatus are preferably each arranged on one end face of the filter apparatus, in particular in such a way that the fluid to be cleaned can flow axially or from above and from below into the filter apparatus. This enables a particularly compact construction of the base station and an easy installation and removal of the filter apparatus.

Optionally, the filter apparatus is equipped with a partition wall that divides the filter apparatus into two chambers. This prevents the entire vacuumed material from collecting at the bottom or at the first connection opening of the filter apparatus and thus impairing the sucking out or emptying of the cleaning device connected thereto.

The aforementioned aspects, features and method steps of the technology as well as the aspects, features and method steps of the present technology resulting from the claims and the following description can in principle be realized independently of each other, but also in any combination or sequence.

BRIEF DESCRIPTIONS OF THE DRAWINGS

Further aspects, advantages, features and properties of the present technology result from the claims and the following description of preferred embodiments with reference to the drawings. It shows:

DETAILED DESCRIPTION

In the partly not to scale, only schematic figures, the same reference signs are used for the same, identical or similar parts and components, resulting in corresponding or comparable properties, characteristics and advantages, even if a repeated description is omitted.

Figure 1:
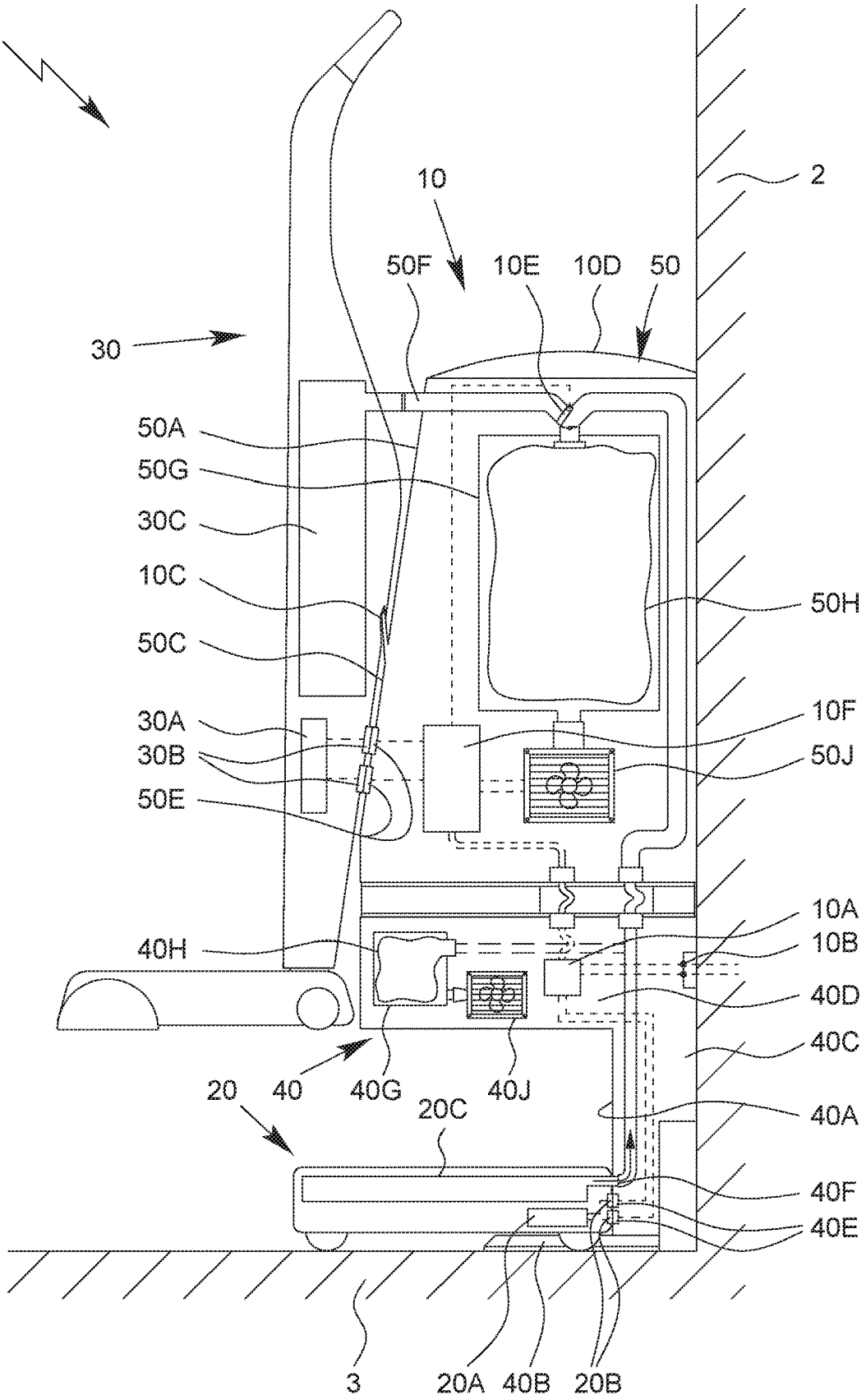
FIG. 1 is a schematic side view of a proposed cleaning system with a proposed base station according to a first embodiment and a plurality of cleaning devices connected thereto in the connection position.

FIG. 1 schematically shows a proposed cleaning system 1 with a proposed base station 10.

The illustration in FIG. 1 shows the cleaning system 1 or the base station 10 in the installed/mounted state or in the usual position of use, in which the base station 10 (at the rear) rests or is fastened to a wall 2 and preferably (at the floor side) rests on a floor 3 or ends or is arranged close to the floor 3.

The cleaning system 1 is preferably equipped with a plurality of components.

Preferably, the cleaning system 1—in addition to the base station 10—has at least one (mobile) cleaning device 20, 30, wherein the cleaning device 20, 30 can be coupled fluidically and/or electrically with the base station 10, in particular to empty/suck out and/or electrically charge the cleaning device 20, 30, as explained in more detail below.

In the embodiment shown in FIG. 1, the cleaning system 1 has a plurality of, here two different, cleaning devices 20, 30, wherein in this case a first cleaning device 20 is designed as a cleaning robot and a second cleaning device 30 as a hand vacuum cleaner. However, other constellations are also conceivable, for example in which the cleaning system 1 has a plurality of cleaning robots.

In the following, the use of the base station 10 with two cleaning devices 20, 30 is described. However, it is also possible that the cleaning system 1 has only one cleaning device 20, 30 or that the base station 10 is used with only one cleaning device 20, 30.

The cleaning system 1 is especially used indoors or for indoor cleaning. However, it is also in principle possible to use the cleaning system 1 in outdoor spaces/areas or to use it for cleaning outdoor spaces or areas.

As already explained at the outset, the base station 10 is designed for (electrical) charging and/or for (automated) maintenance, in particular for emptying or sucking out and/or filling, of one or more cleaning devices 20, 30. For this purpose, the cleaning devices 20, 30 are coupled to the base station 10, whereby a fluidic and/or electrical connection is established—preferably automatically—between the base station 10 and the cleaning devices 20, 30.

The connecting/coupling of the cleaning devices 20, 30 to the base station 10 can be done manually—for example in the case of a hand vacuum cleaner—or automatically or in a self-acting manner—for example in the case of a cleaning robot. In the embodiments shown, it is provided that the first cleaning device 20 connects to the base station 10 automatically or in a self-acting manner after a cleaning process and the second cleaning device 30 is hung into the base station 10 manually or by a user, in order to electrically charge and/or suck out or fill the cleaning devices 20, 30 by means of the base station 10.

The base station 10 is preferably oblong and/or box-shaped or cabinet-like.

It is preferable that the base station 10 is fixed or immovably connected or connectable to the wall 2. However, the base station 10 can in principle also be designed as a free-standing and/or mobile or movable apparatus.

Figure 2:
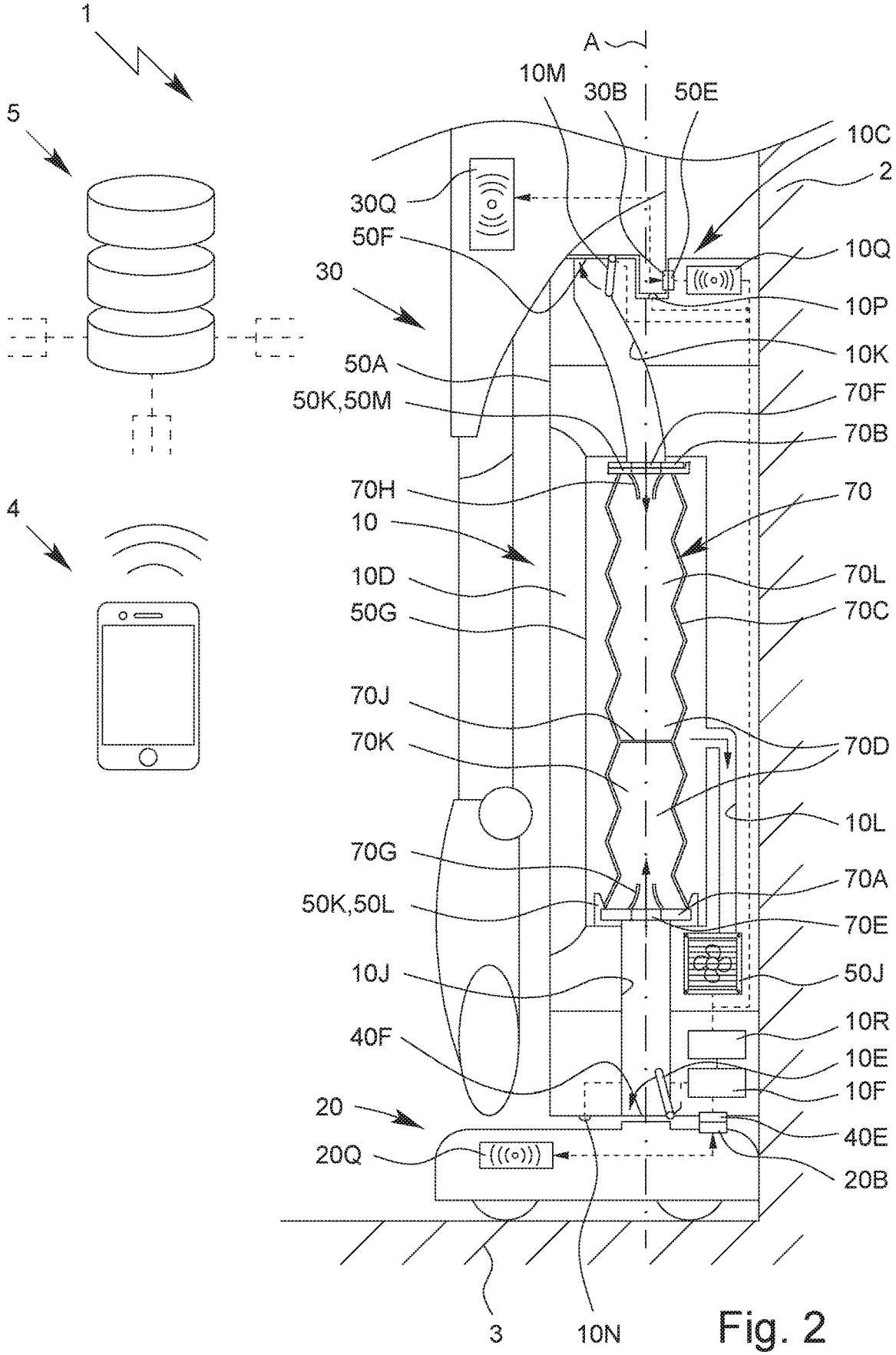
FIG. 2 is a schematic side view of the cleaning system with the proposed base station according to a second embodiment.

Preferably, the base station 10 is mounted on wall 2 in such a way that the base station 10, when installed/mounted, rests on the floor 3 and lies flat against the wall 2. However, other solutions are also possible here, in particular in which the base station 10 in the installed/mounted state is arranged at a distance from the floor 3 and/or suspended from the wall 2, as shown in FIG. 2.

The base station 10 is preferably of multipart or modular construction. Especially preferably, the base station 10 has a plurality of modules or can be expanded/upgraded by one or more modules.

The base station 10 preferably has a bottom module 40 and/or a head module 50, in particular wherein the head module 50 is arranged in the position of use or in the installed/mounted state (directly) above the bottom module 40.

Preferably, the bottom module 40 is designed for the electrical and/or fluidic connection of the first cleaning device 20 and/or the head module 50 is designed for the electrical and/or fluidic connection of the second cleaning device 30. It is thus provided to (electrically) charge, fill and/or empty the first cleaning device 20 by means of the bottom module 40 and/or the second cleaning device 30 by means of the head module 50, in particular from the side, from below and/or from above.

The bottom module 40 is preferably designed to supply the first cleaning device 20 with electrical energy or to charge an accumulator 20A of the first cleaning device 20, which is only indicated schematically in FIG. 1, when and/or as soon as the cleaning device 20 is connected to the base station 10.

FIG. 1 shows the cleaning system 1 or the first cleaning device 20 in the coupling or connection position, in which the cleaning device 20 is electrically connected to the base station 10 or the bottom module 40.

Preferably, the bottom module 40 forms a receiving space 40A for the first cleaning device 20 in order to at least partially accommodate/receive the first cleaning device 20. The first cleaning device 20 can thus at least partially enter or drive into the bottom module 40 to establish a fluidic and/or electrical connection with the base station 10 or bottom module 40.

The bottom module 40 preferably has an in particular flat and/or ramp-shaped foot part 40B, a rear wall 40C and/or an in particular box-like upper part 40D, preferably wherein the receiving space 40A is bounded or defined at the bottom by the foot part 40B, at the rear by the rear wall 40C and at the top by the upper part 40D.

In the installed/mounted state of the base station 10, the foot part 40B rests on the floor 3 and the rear wall 40C preferably against the wall 2.

To electrically connect the base station 10 or the bottom module 40 to the first cleaning device 20, the base station 10 or the bottom module 40 has a (first) electrical connection 40E.

The electrical connection 40E is preferably formed by one or more electrical contacts or—in particular for wireless power transmission—by one or more coils, the electrical contacts or coils being arranged on or in the foot part 40B, the rear wall 40C and/or the upper part 40D, in particular on a side of the foot part 40B, the rear wall 40C and/or the upper part 40D facing the receiving space 40A.

The first cleaning device 20 has an electrical connection 20B corresponding to the electrical connection 40E of the bottom module 40, which is preferably formed by one or more electrical contacts or—in particular for wireless power transmission—by one or more coils on an outer side and/or a bottom side of the cleaning device 20.

The base station 10, in particular the bottom module 40, is equipped with an optional power supply unit 10A—preferably with corresponding charging electronics—and/or a power connection 10B for connection to a power supply system or a mains/grid only indicated schematically, in order to enable a power supply of the first cleaning device 20, the second cleaning device 30, the bottom module 40 and/or the head module 50.

The base station 10, in particular the head module 50, is preferably designed to hold or partially accommodate/receive the second cleaning device 30. In particular, the second cleaning device 30 can be attached to the head module 50 and/or suspended/hung/hooked in the head module 50.

Preferably, the base station 10, in particular the head module 50, has a holder 10C to hold the second cleaning device 30, in particular in a form-fit and/or force-fit manner and/or above or at a distance from the floor 3.

In the embodiment shown, the holder 10C is formed by a hook, the second cleaning device 30 having a bracket corresponding to the hook for suspending the cleaning device 30. However, other solutions are also possible here.

The head module 50 has an in particular box-shaped housing 50A, preferably wherein the housing 50A has or forms the holder 10C.

The second cleaning device 30 can preferably be attached/mounted at a front side 50C of the head module 50. In particular, the front side 50C has the holder 10C. However, solutions are also possible in which the second cleaning device 30 is connected or suspended at the side of the base station 10 or the head module 50.

Preferably, the electrical connection between the base station 10 or the head module 50 and the second cleaning device 30 is established by or at the same time as attaching/hanging or mechanically coupling the cleaning device 30 to the base station 10 or the head module 50.

To establish an electrical connection between the base station 10 or the head module 50 and the second cleaning device 30, the base station 10 or the head module 50 has a (second) electrical connection 50E.

The electrical connection 50E is preferably formed by one or more electrical contacts or—in particular for wireless power transmission—by one or more coils. The electrical contacts or coils are preferably arranged on or in the front side 50C of the head module 50.

In a particularly preferred embodiment, the electrical connection 50E is integrated in the holder 10C (as shown in FIG. 2).

The second cleaning device 30 preferably has an accumulator 30A and an electrical connection 30B corresponding to the electrical connection 50E of the head module 50, preferably wherein the electrical connection 30B is connected to the accumulator 30A of the second cleaning device 30 via one or more electrical lines.

The electrical connection 30B of the second cleaning device 30 is preferably formed by one or more electrical contacts or—in particular for wireless power transmission—by one or more coils on an outer side of the second cleaning device 30.

The electrical connection between the base station 10 or the head module 50 and the second cleaning device 30 or its accumulator 30A is established by—wireless or wired—coupling of the electrical connection 30B of the second cleaning device 30 to the electrical connection 50E of the head module 50. Especially preferably, the electrical connection is established automatically when the second cleaning device 30 is hung in or mechanically coupled to the base station 10 or the head module 50.

In the connection position shown in FIG. 1, the second cleaning device 30 is electrically connected to the base station 10 or the head module 50, in particular the electrical connection 50E, so that the second cleaning device 30 or the accumulator 30A of the second cleaning device 30 is electrically connected to the base station 10 or the head module 50 and the accumulator 30A can be charged by means of the base station 10.

Preferably, the electrical connection 50E is supplied with power from the first power supply unit 10A. Optionally, the head module 50 is (also) equipped with a second or own power supply unit and/or second or own power connection.

Solutions are also possible, in particular for outdoor use, in which the cleaning system 1 or the base station 10 is designed as a self-sufficient or mains-independent cleaning system. For example, the cleaning system 1 or the base station 10 can have one or more solar modules and/or accumulators or be designed as a photovoltaic island system.

The bottom module 40 and the head module 50 are preferably electrically connected to each other, in particular in such a way that the electrical connection 40E of the bottom module 40 and the electrical connection 50E of the head module 50 are electrically connected to the (common) power supply unit 10A.

As already explained, the base station 10 is preferably—in addition or as an alternative to electrical connection—designed for fluidic, in particular pneumatic, connection of at least one, preferably a plurality of, cleaning devices 20, 30.

In order to connect the base station 10 or the bottom module 40 fluidically with the first cleaning device 20, the base station 10 or the bottom module 40 is preferably equipped with a (first) fluidic, in particular pneumatic, connection 40F.

The fluidic connection 40F of the base station 10 or the bottom module 40 is preferably located in the foot part 40B, in the rear wall 40C or in the upper part 40D and/or formed by a connecting piece, an opening or the like in the foot part 40B, in the rear wall 40C or in the upper part 40D. Preferably, the fluidic connection 40F is located directly next to the electrical connection 40E.

In the embodiment shown in FIG. 1, the rear wall 40C has the fluidic connection 40F. The first cleaning device 20 can thus connect fluidically to the base station 10 or the bottom module 40 at the side. However, other solutions are also possible here, in particular where the fluidic connection 40F is integrated in the foot part 40B or the upper part 40D. In this case, the first cleaning device 20 can connect fluidically to the base station 10 or the bottom module 40 at the bottom or top when it drives onto the foot part 40B or is located below the bottom module 40.

It is preferable that the first cleaning device 20 connects both fluidically and electrically to the base station 10 and/or the bottom module 40 (automatically) when it drives onto the foot part 40B and/or against the rear wall 40C and/or when it is in the connection position.

The base station 10 or the bottom module 40 preferably has a (first) container 40G, a (first) filter 40H and/or a (first) working machine 40J, such as a blower/fan or a pump, preferably wherein the fluidic connection 40F is fluidically connected to the container 40G, the filter 40H and/or the working machine 40J.

The container 40G, the filter 40H and/or the working machine 40J are/is preferably located in the upper part 40D of the bottom module 40.

In the embodiment shown, the filter 40H is designed as a filter bag, which is arranged in the container 40G and attached to an inlet of the container 40G.

By connecting the first cleaning device 20 to the base station 10 and/or the bottom module 40, a fluidic connection is preferably established between a collection container 20C of the first cleaning device 20, which is only indicated schematically, and the base station 10 and/or the bottom module 40, in particular the container 40G and/or the working machine 40J.

By means of the working machine 40J it is possible to convey a fluid between the first cleaning device 20 or its collection container 20C and the base station 10 or its container 40G or vice versa.

In the embodiment shown, the working machine 40J is designed as a blower or fan or is designed to convey vacuumed material from the collection container 20C of the first cleaning device 20 into the container 40G of the base station 10 or to suck out the collection container 20C.

In the connection position of the first cleaning device 20, the cleaning device 20 is thus connected fluidically, preferably both fluidically and electrically, to the base station 10, in particular to the bottom module 40, in particular in such a way that the collection container 20C of the first cleaning device 20 can be emptied and/or filled and/or the accumulator 20A can be charged.

The container 40G preferably has a volume greater than the volume of the collection container 20C of the first cleaning device 20, preferably double or triple that of the collection container 20C, so that the entire contents of the collection container 20C can be collected/received by the container 40G.

In addition or as an alternative to the bottom module 40, the head module 50 is designed for fluidic connection of a cleaning device 20 or 30, in this case the second cleaning device 30.

For this purpose, the base station 10 or the head module 50 has a (second) fluidic, in particular pneumatic, connection 50F, preferably wherein the fluid connection 50F is formed by an opening, a connecting piece or the like on the front side 50C of the head module 50.

The fluidic connection 50F is preferably located directly next to the electrical connection 50E of the head module 50.

In a particularly preferred embodiment, the fluidic connection 50F of the head module 50 is integrated into the holder 10C for the second cleaning device 30 (as shown in FIG. 2).

The base station 10 or the head module 50 preferably has a (second) container 50G, a (second) filter 50H and/or a (second) working machine 50J, such as a blower/fan or a pump, preferably wherein the fluidic connection 50F is fluidically connected to the container 50G, the filter 50H and/or the working machine 50J.

In the connection position of the second cleaning device 30, the cleaning device 30 is connected fluidically, particularly preferably both fluidically and electrically, to the base station 10, in particular the head module 50, particularly in such a way that a collection container 30C of the second cleaning device 30 can be emptied and/or filled and/or the accumulator 30A can be charged.

As already described with regard to the electrical connection between the base station 10 and the second cleaning device 30, the optional fluidic connection between the base station 10 or the head module 50 and the second cleaning device 30 or its collection container 30C is preferably also established automatically, when the second cleaning device 30 is hooked/hung into the base station 10 or the head module 50.

The filter 50H is preferably designed as a filter bag and/or arranged in the container 50G. Preferably, the filter 50H is connected or attached to an inlet of the container 50G.

By means of the working machine 50J it is possible to convey a fluid from the second cleaning device 30 or its collection container 30C to the base station 10 or its container 50G or vice versa.

In the embodiment shown, the working machine 50J is designed as a blower or fan and/or designed to reduce the pressure in the container 50G and thus to convey vacuumed material from the collection container 30C of the second cleaning device 30 into the container 50G or to suck out the collection container 30C.

Preferably, the base station 10 or the head module 50 is equipped with a flap 10D to open and/or empty the base station 10, in particular the head module 50 or the container 50G and/or the bottom module 40 or the container 40G, and/or to change the filter 50H and/or 40H.

In the embodiment shown, the flap 10D is designed as a removable or swivelling lid. However, it is also possible, for example, to provide the front side 50C with the flap 10D, as shown in FIG. 2.

Due to the fluidic connection between the base station 10 and the cleaning devices 20, 30 it is possible to fill or empty, in particular to suck out, the cleaning devices 20, 30 in the connection position.

For example, via the fluidic connection 40F of the bottom module 40 vacuumed material can be sucked from the collection container 20C of the first cleaning device 20 and/or via the fluidic connection 50F of the head module 50 vacuumed material can be sucked from the collection container 30C of the second cleaning device 30 and can be transferred (in both cases) into the container 40G of the bottom module 40 and/or into the container 50G of the head module 50. In this way, manual emptying of the cleaning devices 20, 30 can be omitted.

However, it is also possible that a liquid, such as a cleaning agent, is conveyed or pumped into the collection container 20C of the first cleaning device 20 and/or into the collection container 30C of the second cleaning device 30 via the fluidic connection 40F of the bottom module 40 and/or via the fluidic connection 50F of the head module 50. In this case, the working machine(s) 40J and/or 50J is/are (each) preferably designed as pump(s).

The bottom module 40 and the head module 50 are preferably fluidically connected or connectable with each other, in particular in order to fluidically connect the first cleaning device 20 with the head module 50 or the second cleaning device 30 with the bottom module 40 and/or to empty or fill the second cleaning device 30 (also) by means of the bottom module 40 or the first cleaning device 20 (also) by means of the head module 50.

Particularly preferably, the fluidic connection 40F of the bottom module 40 and the fluidic connection 50F of the head module 50 are fluidically connected to a common container and/or a common working machine, in particular the container 40G and/or the working machine 40J of the bottom module 40 or the container 50G and/or the working machine 50J of the head module 50, in order to empty or fill the cleaning devices 20, 30 by means of the common container and/or the common working machine.

In the configuration shown in FIG. 1, both cleaning devices 20, 30 are fluidically connected to the head module 50 or its container 50G and/or its working machine 50J, so that the contents of the collection container 20C of the first cleaning device 20 and the contents of the collection container 30C of the second cleaning device 30 can be conveyed into the container 50G by means of the (common) working machine 50J. Alternatively, both cleaning devices 20, 30 could be fluidically connected to the bottom module 40 or its container 40G and/or its working machine 40J.

The container 50G or the filter 50H has an inlet, wherein in the embodiment shown both cleaning devices 20, 30 and/or both fluidic connections 40F, 50F are connected to the inlet fluidically and/or via corresponding lines.

Preferably, the base station 10 has an optional (controlled) shut-off apparatus 10E, such as a shut-off flap or a (butterfly) valve, to control the air flow and/or the air conduction. In particular, by means of the shut-off apparatus 10E, it is possible to connect selectively the first cleaning device 20/the fluidic connection 40F or the second cleaning device 30/the fluidic connection 50F to the container 50G or the filter 50H.

The base station 10 preferably has a control device 10F, which controls the (electrical) charging, emptying and/or filling of the cleaning devices 20, 30. For this purpose the control device 10F is preferably electrically connected to the (first) electrical connection 40E, the (second) electrical connection 50E, the power supply unit 10A, the (first) working machine 40J, the (second) working machine 50J and/or the shut-off apparatus 10E.

As already explained, the cleaning system 1 and/or the base station 10 is preferably of modular design and can be extended/expanded/upgraded by one or more modules.

Due to the modularity of the cleaning system 1 and/or the base station 10, an existing module, for example the bottom module 40, can be joined with another module, for example the head module 50, in order to be able to connect another cleaning device 20, 30 to the base station 10 and/or to add additional functions to the base station 10, such as the sucking out. In addition, the added module can take over one or more functions.

In the example shown, both modules 40, 50 can be used for sucking out and charging the cleaning devices 20, 30, but it is preferred that one or more functions are performed by the bottom module 40 or the head module 50.

In the following a further, particularly preferred embodiment of the cleaning system 1 or the base station 10 is described with reference to FIG. 2 and FIGS. 3A to 3C.

The second embodiment corresponds at least essentially to the first embodiment, so that—even if no explicit reference is made to it—the explanations given in connection with the first embodiment apply accordingly to the second embodiment and vice versa.

In particular, the embodiment described below has one or more features that have been described exclusively in connection with FIG. 1. In addition, one or more features of the second embodiment may also be provided for the first embodiment. In particular, the proposed method can be performed with both the base station 10 according to the first embodiment and the base station 10 according to the second embodiment.

As already mentioned at the outset, the base station 10 is designed to maintain the cleaning devices 20, 30 at the same time/simultaneously and/or according to a—in particular predefined and/or electronically saved/stored—prioritization, in particular to empty them or suck them out and/or to fill them with a cleaning agent, and/or to (electrically) charge them, particularly preferably automatically or in a self-acting manner.

In the embodiment shown in FIG. 2, the base station 10 has a blower or fan as a working machine 40J or 50J to suck the vacuumed material out of the cleaning devices 20, 30.

In the following, the simultaneous or prioritized emptying or sucking out of the cleaning devices 20, 30 is described. However, the cleaning devices 20, 30 can in principle also be charged electrically and/or filled, for example, with a cleaning agent simultaneously or prioritized.

As already explained in connection with the first embodiment, the base station 10 may have one or more containers 40G or 50G, one or more filters 40H or 50H and/or one or more working machines 40J or 50J.

In the embodiment shown, it is preferred that the base station 10 has a container 50G, a filter 50H arranged in the container 50G, hereinafter referred to as filter apparatus 70, and a working machine 50J.

The container 50G is preferably elongated and/or at least substantially cylindrical. Preferably the container 50G is arranged coaxially in the housing 50A. In particular, the main axis A of the preferably elongated base station 10 (also) forms a longitudinal axis of the container 50G.

Preferably, the container 50G or its longitudinal axis is at least substantially vertically aligned in the installed/mounted state of the base station 10.

It is preferred that the container 50G is larger than the collection container 20C of the first cleaning device 20 and/or the collection container 30C of the second cleaning device 30, in particular by at least double or triple the size, so that the entire contents of the collection container 20C of the first cleaning device 20 and/or the of the collection container 30C of the second cleaning device 30 can be collected/received by the container 50G.

Particularly preferably, the volume of the container 50G is greater than the combined volume of the collection container 20C of the first cleaning device 20 and the collection container 30C of the second cleaning device 30, in particular by at least double or triple the size. In this way, it is possible to take up the entire contents of both collection containers 20C, 30C of the cleaning devices 20, 30 into the container 50G.

The container 50G preferably has a volume of more than 1 l or 1.5 l, especially preferably more than 2 l or 3 l.

The container 50G is fluidically connected via a first or lower supply line 10J to the first fluidic connection 40F, via a second or upper supply line 10K to the second fluidic connection 50F and/or via an in particular lateral suction line 10L to the working machine 50J and/or an outlet in the housing 50A.

In the embodiment shown, the lines 10J, 10K and 10L are arranged in such a way that air can enter the container 50G axially or from above and below and exit the container 50G radially or laterally.

Preferably, the first supply line 10J discharges axially from below and the second supply line 10K axially from above into the container 50G. This allows a particularly simple air flow or air conduction and a particularly compact construction of the base station 10. However, other arrangements are also possible, in particular where the first supply line 10J is led past the side of the container 50G to discharge into the second supply line 10K or together with the second supply line 10K into the container 50G, as shown in FIG. 1.

The container 50G is preferably designed to receive/accommodate the filter apparatus 70.

The filter apparatus 70 is preferably a (disposable) filter, in particular a (disposable) filter cartridge, which is preferably exchanged or replaced by a new filter or a new filter cartridge after use or when a certain filling quantity is reached.

Preferably, the container 50G can be accessed or opened via the flap 10D, in particular to insert or remove the filter apparatus 70. In contrast to the first embodiment, the flap 10D is preferably located at the front side 50C of the base station 10, in particular in such a way that the container 50G can be opened from the front or the front side 50C of the base station 10 and the filter apparatus 70 can be exchanged.

FIG. 2 shows the filter apparatus 70 in the inserted state, in which the filter apparatus 70 is fluidically connected to the lines 10J, 10K and 10L.

The filter apparatus 70 has—at least in the inserted state—an elongated or cylinder-like shape and/or a shape corresponding to the container 50G.

Preferably the filter apparatus 70 is arranged coaxially in the housing 50A. In particular, the main axis A of base station 10 (also) forms a longitudinal axis of the filter apparatus 70.

Preferably, the filter apparatus 70 or its longitudinal axis is at least essentially vertically aligned in the inserted state. In this way, the available space of the base station 10 is optimally used.

The filter apparatus 70 preferably has a first or lower connecting part 70A, a second or upper connecting part 70B, a filter element or filter medium 70C and/or a filter compartment 70D, preferably wherein the connecting parts 70A, 70B define/delimit the filter compartment 70D axially and the filter element 70C defines/delimits the filter compartment 70D radially.

The connecting parts 70A, 70B preferably each form a front face and/or an axial end of the preferably elongated/cylindrical filter apparatus 70.

The filter element 70C is preferably located between the first connecting part 70A and the second connecting part 70B.

The connecting parts 70A, 70B are preferably each rigid and/or formed by a rigid, preferably plate-like or disk-like, element.

The filter element 70C is preferably flexible and/or formed by an in particular flexible and/or multi-layer filter material or filter medium, such as a woven fabric, paper and/or non-woven fabric.

In the embodiment shown, the filter apparatus 70, in particular the filter element 70C, is folded and/or designed as an extendable bellows. In this way it is possible to reduce the transportation size of the filter apparatus 70.

The filter apparatus 70 preferably has a first or lower connection opening 70E and a second or upper connection opening 70F, preferably with the connection openings 70E, 70F being arranged on different front faces of the filter apparatus 70.

Preferably, the first connection opening 70E is located in the first connecting part 70A and the second connection opening 70F in the second connecting part 70B.

The arrangement of the connection openings 70E, 70F makes it possible to fill the filter apparatus 70—in particular simultaneously—from different sides or from above and below. In this way, the air flow/conduction in the base station 10 is simplified. In particular, there is no need for a separate line that runs laterally next to the container 50G and guides air from the bottom to the top or vice versa. This enables a particularly compact construction of the base station 10.

However, it is also possible that the filter apparatus 70 only has one connection opening 70E or 70F, as already explained with regard to the first embodiment.

The filter apparatus 70 is preferably connected to the first fluidic connection 40F of the base station 10 via the first connection opening 70E and/or the first supply line 10J and to the second fluidic connection 50F of the base station 10 via the second connection opening 70F and/or the second supply line 10K.

In particular, air can be sucked into the filter compartment 70D via the first connection opening 70E or the first supply line 10J or from below and via the second connection opening 70F or the second supply line 10K or from above.

Optionally, the filter apparatus 70 has a first or lower closure flap or non-return flap/valve 70G and a second or upper closure flap or non-return flap/valve 70H for the retention or retaining of vacuumed material, the first non-return flap 70G being assigned to the first connection opening 70E and the second non-return flap 70H to the second connection opening 70F.

The connection openings 70E, 70F can be closed or opened by means of the non-return flaps 70G, 70H. In particular, the connection openings 70E, 70F are (exclusively) actuated, in particular closed or opened, mechanically or by the air flow.

Preferably the non-return flaps 70G, 70H are each formed by at least one flexible/bendable element, such as a rubber tab, which bends in the direction of flow or clears/unblocks the respective connection opening 70E or 70F only when air is sucked in through the respective connection opening 70E or 70F.

The filter compartment 70D is preferably divided into a plurality of, here two, filter chambers 70K, 70L.

Preferably, the filter apparatus 70 has a partition wall 70J, which is arranged in the filter compartment 70D and/or divides the filter compartment 70D into a first or lower filter chamber 70K and a second or upper filter chamber 70L.

The first connection opening 70E is preferably assigned to the first filter chamber 70K and the second connection opening 70F to the second filter chamber 70L. The first connection opening 70E thus forms an inlet for the first filter chamber 70K and the second connection opening 70F forms an inlet for the second filter chamber 70L.

The filter chambers 70K, 70L are preferably the same size, but can also be of different sizes, preferably with the first filter chamber 70K being smaller than the second filter chamber 70L, as indicated in FIG. 2.

Preferably, the partition wall 70J is airtight or impermeable. However, it is also possible that the partition wall 70J is permeable or formed by a permeable material, in particular a filter material.

Preferably, the partition wall 70J is arranged at the level/height of the outlet of the container 50G to allow uniform sucking out of the filter chambers 70K, 70L.

The division of the filter compartment 70D into the two filter chambers 70K, 70L prevents that all the vacuumed material collects in the filter apparatus 70 at the bottom or at the first connection opening 70E and thus impairs the air supply or blocks the opening of the first non-return flap 70G.

The filter apparatus 70, in particular the first connecting part 70A and/or the second connecting part 70B, are/is preferably attached/fixed or held in the container 50G by form-fit or force-fit.

The base station 10, in particular the container 50G, has a holder 50K to hold the filter apparatus 70—in particular at the top and bottom—in the container 50G.

The base station 10, in particular the container 50G, preferably has a first or lower holding part 50L for the first connecting part 70A and a second or upper holding part 50M for the second connecting part 70B, preferably with the holding parts 50L, 50M forming the holder 50K.

The first holding part 50L is preferably designed to hold the first connecting part 70A by form-fit and/or force-fit and/or to fix it at the bottom. In the embodiment shown, the first holding part 50L is formed by one or more snap-on hooks which grip around the first connecting part 70A.

The second holding part 50M is preferably designed to hold the second connecting part 70B by form-fit and/or force-fit and/or at the top. In the embodiment shown, the second holding part 50M is formed by a groove or slot into which the second connecting part 70B is inserted/slid/suspended.

As already explained, the filter apparatus 70 is exchangeable/replaceable or removable from the container 50G. In the following, the insertion of the filter apparatus 70 into the base station 10 is explained in more detail with reference to FIGS. 3A to 3C.

The filter apparatus 70, in particular the filter compartment 70D and/or the filter chambers 70K, 70L, is/are—preferably by folding the filter element 70C—reduced or compressed in the delivery state of the filter apparatus 70, preferably to less than 90% or 80%, particularly preferably to less than 60% or 40%, of the volume of the filter apparatus 70, in particular of the filter compartment 70D and/or the filter chambers 70K, 70L, in the inserted or (completely) expanded state of the filter apparatus 70.

Figures 3A, 3B, 3C:
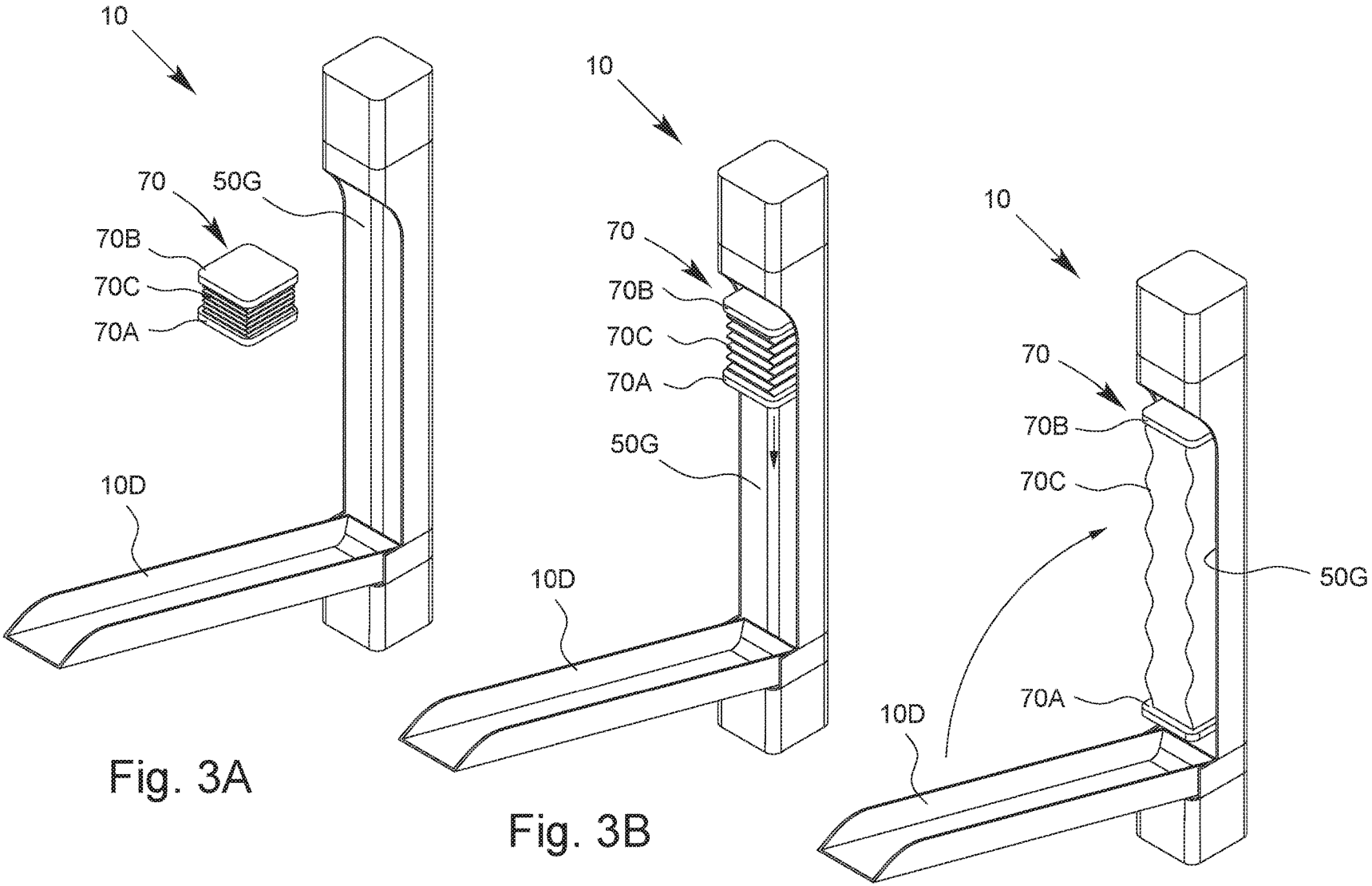
FIG. 3A is a perspective view of the base station according to FIG. 2 when inserting a proposed filter apparatus.
FIG. 3B is a perspective view of the base station according to FIG. 2 with the filter apparatus inserted and partially expanded.
FIG. 3C is a perspective view of the base station according to FIG. 2 with the filter apparatus fully expanded.

FIG. 3A shows the base station 10 with swung open flap 10D or opened container 50G and the filter apparatus 70 in the delivery state or in the compressed state.

Preferably, the filter apparatus 70 is only expanded or pulled apart in the base station 10 or in the container 50G. However, it is in principle also possible to expand the filter apparatus 70 outside the base station 10 or the container 50G and to insert it in the expanded state into the base station 10 or the container 50G.

As shown in FIG. 3B, the filter apparatus 70 is preferably first attached at the top or to the second holding part 50M, in particular pushed or slid into the second holding part 50M, and (subsequently) pulled apart or unfolded.

In particular, first the second connecting part 70B is inserted or pushed/slid into the holder 50K or the second holding part 50M and then the first connecting part 70A is pulled downwards or in the direction of the first holding part 50L.

However, it is in principle also possible to attach the filter apparatus 70, in particular the first connecting part 70A, first at the bottom or at the first holding part 50L and then to pull the second connecting part 70B upwards or in the direction of the second holding part 50M.

FIG. 3B shows the filter apparatus 70 in the inserted but not yet fully expanded state. FIG. 3C shows the filter apparatus 70 in the fully expanded state, in which the first connecting part 70A is attached to the first holding part 50L and the second connecting part 70B to the second holding part 50M.

The flap 10D is closed in a final step, preferably airtight or in such a way that air flows into the container 50G exclusively via the supply lines 10J, 10K when the working machine 50J is in operation.

As already explained, the cleaning devices 20, 30 are (automatically) emptied/sucked out by the base station 10 simultaneously or according to a prioritization or one after the other, especially preferably selectively simultaneously or according to a prioritization.

It is thus preferable that in the connection position of the cleaning devices 20, 30 the air-flow or air conduction in the base station 10 can be changed, in particular in order to be able to suck out selectively either exclusively one cleaning device 20 or 30 or both cleaning devices 20, 30 (simultaneously).

In the following, reference is again made to FIG. 2 to describe the operating mode of the base station 10 in more detail, in particular the emptying of the cleaning devices 20 or 30 by means of the base station 10.

In order to change the air flow or air conduction in the base station 10, the base station 10 has the shut-off apparatus 10E, preferably the shut-off apparatus 10E being designed as a shut-off flap or butterfly valve and being arranged in one of the supply lines 10J or 10K.

In the embodiment shown in FIG. 2, the base station 10 has two shut-off apparatuses 10E and 10M, which are in particular controlled or connected to the control device 10F, preferably wherein the first shut-off apparatus 10E is assigned to the first supply line 10J and/or the first fluidic connection 40F and the second shut-off apparatus 10M is assigned to the second supply line 10K and/or the second fluidic connection 50F.

By means of the first shut-off apparatus 10E it is possible to control the flow in the first supply line 10J or to selectively open or close the first supply line 10J, and/or to selectively establish or interrupt a fluidic connection between the filter compartment 70D, in particular the first filter chamber 70K, and the first cleaning device 20, in particular its collection container 20C.

By means of the second shut-off apparatus 10M it is possible to control the flow in the second supply line 10K or to selectively open or close the second supply line 10K, and/or to selectively establish or interrupt a fluidic connection between the filter compartment 70D, in particular the second filter chamber 70L, and the second cleaning device 30, in particular its collection container 30C.

However, solutions are also possible in which only one shut-off apparatus 10E or 10M is used to empty or suck out the cleaning devices 20 or 30 simultaneously and/or successively. For example, the (first) shut-off apparatus 10E can be designed as a 3/2-way valve or 3/3-way valve connected to both supply lines 10J, 10K and the inlet of the container 50G.

The control device 10F is designed to control the shut-off apparatuses 10E, 10M—in particular independently of each other—i.e. to close or open them selectively or as required. The shut-off apparatuses 10E, 10M preferably each have a corresponding actuator (not shown) which is controlled by the control device 10F.

The shut-off apparatuses 10E, 10M or the supply lines 10J, 10K are preferably normally closed and/or are preferably only (automatically) actuated or opened when the associated cleaning device 20 or 30 is connected to the base station 10 or has assumed the connection position. This prevents vacuumed material from escaping from the base station 10 or the container 50G.

Preferably the shut-off apparatuses 10E, 10M are controlled or actuated independently of each other. In this way it is possible to open or close only one or (simultaneously) both shut-off apparatuses 10E, 10M or to empty/suck out only one or (simultaneously) both cleaning devices 20, 30.

In order to empty the cleaning devices 20, 30 simultaneously, preferably the shut-off apparatuses 10E, 10M are actuated or—in particular completely—opened.

In particular, it is possible to first actuate or open one shut-off apparatus 10E or 10M, for example the first shut-off apparatus 10E, and then—in particular additionally or alternatively—to actuate or open another shut-off apparatus 10E or 10M, for example the second shut-off apparatus 10M, in particular in order to first empty/suck out one cleaning device 20 or 30, for example the first cleaning device 20, and then—in particular additionally or alternatively—another cleaning device 20 or 30, for example the second cleaning device 30.

The suction process, i.e. the emptying/sucking out of the cleaning devices 20 or 30, is preferably started by—in particular completely—opening the respective shut-off apparatus 10E or 10M.

The working machine 50J is preferably activated or switched on (immediately) before, together with or (immediately) after—in particular completely—opening the respective shut-off apparatus 10E or 10M, in particular by means of the control device 10F.

The suction process of the cleaning devices 20 or 30 is preferably ended/terminated by—in particular completely—closing the respective shut-off apparatus 10E or 10M.

The working machine 50J is preferably deactivated or switched off (immediately) before, together with or (immediately) after—in particular completely—closing the respective shut-off apparatus 10E or 10M.

The suction process, in particular the opening of the respective shut-off apparatus 10E or 10M and/or the activation of the working machine 50J, can be (automatically) started immediately or with a time delay, for example 10 seconds, after connecting the cleaning devices 20, 30.

However, the suction process, in particular the opening of the respective shut-off apparatus 10E or 10M and/or activation of the working machine 50J, can also be (automatically) performed or started depending on the filling level of the respective collection container 20C or 30C, in particular only when a predefined filling level of the respective collection container 20C or 30C is exceeded.

Preferably, the cleaning devices 20, 30 are equipped with a corresponding sensor system (not shown) to determine the filling level of the collection containers 20C or 30C.

It may therefore be provided that a cleaning device 20 or 30 is connected to the base station 10, for example to (electrically) charge the cleaning device 20 or 30, but is not sucked out because the filling level of the respective collection container 20C or 30C has not yet reached or exceeded a predefined value and, for example, a (further) cleaning process with the cleaning device 20 or 30 is still possible.

Preferably, the suction process is carried out for a certain or predefined period of time, for example 10 or 20 seconds, or is terminated depending on the filling level of the respective collection container 20C or 30C, in particular after the filling level of the respective collection container 20C or 30C falls below a predefined level.

In particular, the respective shut-off apparatuses 10E or 10M and/or the working machine 50J are (automatically) closed or deactivated after a certain or predefined period of time, for example 10 or 20 seconds, or depending on the filling level of the respective collection container 20C or 30C, in particular after the filling level of the respective collection container 20C or 30C falls below a predefined level.

For example, the first supply line 10J or the first shut-off apparatus 10E is—in particular completely—opened or the suction process is started as soon as the first cleaning device 20 is connected to the base station 10 or is in the connection position.

As soon as the first cleaning device 20, in particular the collection container 20C, is completely emptied, the first supply line 10J or the first shut-off apparatus 10E is—in particular completely—closed (automatically).

In the event that, during the suction process of a cleaning device 20 or 30, another cleaning device 20 or 30, for example the second cleaning device 30, is connected to the base station 10, the second supply line 10K or the second shut-off apparatus 10M is preferably opened in addition, in particular in order to suck out both cleaning devices 20, 30 simultaneously.

In a particularly preferred method variant, the power, in particular the revolution speed, of the working machine 50J is increased—at least temporarily—if both cleaning devices 20 or 30 are connected to the base station 10 and/or are sucked out simultaneously and/or if both shut-off apparatuses 10E, 10M are opened. In this way, the cleaning devices 20, 30 can (always) be sucked out evenly and/or with the same power per cleaning device 20, 30, regardless of whether only one suction process takes place or a plurality of suction processes take place simultaneously.

Particularly preferably, the power, in particular the revolution speed, of the working machine 50J is (again) reduced if a cleaning device 20 or 30 has been emptied before another cleaning device 20 or 30 and/or if a shut-off apparatus 10E or 10M is closed and another shut-off apparatus 10E or 10M remains open.

However, it is also possible that the suction process of one cleaning device 20 or 30, for example the first cleaning device 20, is (temporarily and/or automatically) stopped or interrupted when another cleaning device 20 or 30, for example the second cleaning device 30, is connected to the base station 10.

Particularly preferably, the first supply line 10J or the first shut-off apparatus 10E is closed or the suction process of the first cleaning device 20 is (automatically) interrupted and (instead) the second supply line 10K or the second shut-off apparatus 10M is—in particular completely—opened or the suction process of the second cleaning device 30 is (automatically) started, when the second cleaning device 30 is connected to the base station 10, in particular to exclusively or primarily or prioritized suck out the second cleaning device 30.

Only when the suction process of the second cleaning device 30 is completed or the second cleaning device 30 is completely empty, the suction process of the first cleaning device 20 is—in particular automatically—started/continued or the first shut-off apparatus 10E is (again) opened.

It is therefore provided according to a particularly preferred method variant that the second cleaning device 30 has priority over the first cleaning device 20, thus it is emptied and/or filled with priority over the first cleaning device 20 by means of the base station 10. Namely, particularly preferably, the cleaning devices 20, 30 are emptied/sucked out by the base station 10 according to a prioritization.

Especially preferably, emptying/sucking out and/or filling the first cleaning device 20 is only—in particular automatically—(re)started when the second cleaning device 30 is removed from the base station 10 and/or used by a user.

Preferably, the base station 10 has one or more sensors 10N, 10P to detect whether the first cleaning device 20 and/or the second cleaning device 30 is connected to the base station 10.

In the embodiment shown, the base station 10 has a first or lower sensor 10N and a second or upper sensor 10P, the first sensor 10N being assigned to the bottom module 40 and/or the first cleaning device 20 and the second sensor 10P being assigned to the head module 50 and/or the second cleaning device 30.

By means of the first sensor 10N it is possible to detect whether the first cleaning device 20 is in the connection position, in particular whether it is below the base station 10, and/or can be fluidically coupled to the base station 10.

By means of the second sensor 10P it is possible to detect whether the second cleaning device 30 is in the connection position, in particular whether it is suspended in the base station 10, and/or can be fluidically coupled to the base station 10.

The sensors 10N, 10P can be, for example, resistive, inductive, magnetic, capacitive, piezoelectric and/or optoelectronic sensors.

Additionally or alternatively, the electrical connections 40E and/or 50E can be used for the detection of the cleaning devices 20, 30 or for the sensors 10N, 10P.

As indicated in FIG. 2, the cleaning system 1 and/or the base station 10 can be coupled with further devices (in terms of data connections).

The cleaning system 1 and/or the base station 10 is preferably designed for data exchange and/or signal transmission with further devices.

Preferably, the cleaning system 1 is equipped and/or connectable (in terms of a data connection) with a mobile device 4, such as a tablet, smartphone or the like, and/or with a central unit 5.

A central unit in the sense of the present technology is preferably a data processor or computer, a server or a server network. However, a central unit can also be a virtual unit of several data processors/computers and/or servers and/or can be implemented by so-called cloud computing.

Preferably, the mobile device 4 and/or the central unit 5 are/is located physically separated and/or at a distance from the base station 10.

Preferably, a wired or wireless data connection can be established between the base station 10, the first cleaning device 20, the second cleaning device 30, the mobile device 4 and/or the central unit 5, in particular in order to transmit a signal and/or information or to exchange a signal and/or information between the base station 10, the first cleaning device 20, the second cleaning device 30, the mobile device 4 and/or the central unit 5.

The data exchange and/or signal transmission between the cleaning devices 20, 30 and the base station 10 can take place directly or indirectly, in particular via the mobile device 4 and/or the central unit 5.

A signal in the sense of the present technology is preferably a means of transmitting information, a (modulated) wave, in particular in a conductor, a bit sequence, a packet in the information technological sense or the like.

Preferably a signal in the sense of the present technology is transmittable via a—wireless or wired—data connection. Particularly preferably, one or more pieces of information are assigned to a signal and/or contained in the signal, said pieces of information being transmittable by means of the signal.

In order to enable data exchange between the base station 10, the first cleaning device 20, the second cleaning device 30, the mobile device 4 and/or the central unit 5, or to transmit a signal, preferably the base station 10 has a communication apparatus 10Q, the first cleaning device 20 a first communication device 20Q and/or the second cleaning device 30 a second communication device 30Q.

The communication apparatus 10Q and/or the communication devices 20Q, 30Q preferably has/have (each) a receiver for receiving and/or a transmitter for transmitting a signal. Particularly preferably, the communication apparatus 10Q and/or the communication devices 20Q, 30Q has/have a radio interface, in particular a WPAN interface, a near-field communication interface, in particular an NFC interface, a WLAN interface or another, particularly preferably wireless, interface.

Additionally or alternatively, the electrical connections 20B, 30B are used for the preferably wired data exchange between the base station 10, the first cleaning device 20 and/or the second cleaning device 30, in particular when the cleaning devices 20, 30 are in the connection position.

As already explained, the suction process or the emptying of the cleaning devices 20, 30 is preferably started/performed automatically or in self-acting manner, in particular as soon as the cleaning devices 20, 30 are in the connection position and/or are detected by the sensors 10N, 10P.

However, by means of the data exchange it is also possible that the base station 10, in particular the suction process or the emptying of the cleaning devices 20, 30, is controlled, in particular started and/or terminated, by means of the mobile device 4, the central unit 5 and/or a cleaning device 20 or 30.

For example, an (existing) control element of a cleaning device 20 or 30, such as the on/off switch, can be used to start the suction process of the cleaning device 20 or 30. Thus, no separate control element needs to be provided for starting the suction process on the cleaning device 20 or 30.

Preferably, the first cleaning device 20, in particular the communication device 20Q, and/or the second cleaning device 30, in particular the communication device 30Q, transmits information or a status signal with information, in particular about the cleaning process carried out, the filling level of the respective collection container 20C or 30C and/or the charging status of the respective accumulator 20A or 30A to the base station 10, in particular the communication apparatus 10Q, the mobile device 4 and/or the central unit 5, in particular in order to control, start or end the suction process and/or charging process by means of the base station 10.

The data transmission is preferably carried out when the cleaning devices 20, 30 are connected to the base station 10 and/or are in use. However, it is also possible for data transmission between base station 10 and cleaning devices 20, 30 to take place continuously or at intervals.

The base station 10 preferably has a data processing apparatus 10R, preferably wherein the data processing apparatus 10R is formed by a computer and/or has at least one (central) processor and/or a working memory.

The data processing apparatus 10R is preferably electrically connected to the communication apparatus 10Q and the control device 10F and/or spatially spaced from the communication apparatus 10Q and the control device 10F. However, the data processing apparatus 10R can also be integrated into the communication apparatus 10Q or the control device 10F.

Preferably, the data processing apparatus 10R is designed to evaluate the signals or information received by means of the communication apparatus 10Q and/or to transmit them as input values to the control device 10F.

In particular, the status signal transmitted by the cleaning devices 20, 30 is evaluated in order—for example, depending on the filling level—to suck out the first cleaning device 20 and/or the second cleaning device 30, thus to open the first shut-off apparatus 10E and/or the second shut-off apparatus 10M and/or to activate the working machine 50J.

However, it is also possible that the mobile device 4 and/or the central unit 5, depending on the received status signal, control/controls the base station 10, in particular the shut-off apparatuses 10E, 10M and/or the working machine 50J.

Preferably, the base station 10, in particular the data processing apparatus 10R, has a memory, such as a hard disk, EPROM or the like, in which one or more pieces of information, in particular on the prioritization of the cleaning devices 20, 30 are stored or can be stored.

However, it is also possible that the mobile device 4 and/or the central unit 5 contains or stores one or more pieces of information on the prioritization of the cleaning devices 20 and/or 30.

Preferably, the data processing apparatus 10R, the mobile device 4 and/or the central unit 5 access the memory in order to control the suction process on the basis of the information stored there. Particularly preferably, the data processing apparatus 10R, the mobile device 4 and/or the central unit 5 can modify the data stored in the memory, in particular change the prioritization.

Preferably, the base station 10 is operated and/or configured by means of the mobile device 4. In particular, it is possible to change the prioritization of the cleaning devices 20, 30 and/or to configure a suction process by means of the mobile device 4, in particular to change the (automatic) start, the length and/or the (automatic) end of a suction process, and/or to start or end a suction process.

Alternatively or additionally, the base station 10 may have an input apparatus, such as a touch screen (not shown), which enables a user to configure the base station 10, in particular to change the prioritization, the (automatic) start, the length and/or the (automatic) end of a suction process, and/or to start or end a suction process.

The term "prioritization" in the sense of the present technology is preferably understood to mean a defined and/or (electronically) stored (order of) priority of the cleaning devices 20 or 30 when maintaining by means of the base station 10.

Preferably, the prioritization is or contains information associated with the cleaning devices 20 or 30, preferably stored (electronically) in the mobile device 4, the central unit 5 and/or the base station 10, which determines the sequence/order of maintenance and/or by means of which it is determined which cleaning device 20 or 30 is emptied and/or filled with priority or subordination.

In particular, the shut-off apparatuses 10E, 10M are controlled by means of the prioritization in such a way that the prioritized or priority cleaning device 20 or 30 is fluidically connected to the base station 10, in particular the filter apparatus 70, before the subordinate cleaning device 20 or 30 and/or is sucked out by the base station 10 before the subordinate cleaning device 20 or 30.

Individual aspects, features and method steps of the present technology can be realized independently, but also in any combination and/or sequence.

In particular, the present technology relates also to any one of the following aspects which can be realized independently or in any combination, also in combination with any aspects described herein:

1. Method for operating a cleaning system (1) with a plurality of mobile cleaning devices (20, 30) and a base station (10) for the cleaning devices (20, 30), preferably wherein the base station (10) is designed according to one of aspects 8 to 11, wherein the cleaning devices (20, 30) are emptied and/or filled with a cleaning agent by the base station (10) simultaneously or according to a prioritization.

2. Any of the above aspects, characterized in that the cleaning devices (20, 30) are emptied and/or filled selectively at the same time or one after the other.

3. Any of the above aspects, characterized in that a first cleaning device (20) is emptied and/or filled by means of the base station (10) subordinated and/or a second cleaning device (30) is emptied and/or filled by means of the base station (10) with priority.

4. Any of the above aspects, characterized in that emptying and/or filling of a first cleaning device (20) is interrupted when a second cleaning device (30) is connected to the base station (10).

5. Any of the above aspects, characterized in that emptying and/or filling of a first cleaning device (20) is started or continued when a second cleaning device (30) has been completely emptied or filled and/or is in use.

6. Any of the above aspects, characterized in that emptying and/or filling of the cleaning devices (20, 30) is started or ended depending on the filling level of the cleaning devices (20, 30).

7. Any of the above aspects, characterized in that emptying and/or filling of a first cleaning device (20) is controlled by means of a second cleaning device (30) and/or a mobile device (4).

8. Base station (10) for fluidic connection of a plurality of mobile cleaning devices (20, 30), characterized in that the base station (10) is designed for simultaneously emptying the cleaning devices (20, 30) and/or for simultaneously filling the cleaning devices (20, 30) with a cleaning agent, and/or in that the base station (10) comprises a filter apparatus (70) according to one of aspects 12 to 15.

9. Any of the above aspects, characterized in that the base station (10) has a bottom module (40) and a head module (50) fluidically connected to the bottom module (40), the bottom module (40) having a fluidic, in particular pneumatic, connection (40F) for a first cleaning device (20) and/or the head module (50) having a fluidic, in particular pneumatic, connection (50F) for a second cleaning device (30).

10. Any of the above aspects, characterized in that the base station (10) has a working machine (50J), in particular a blower and/or a pump, for fluid exchange with the cleaning devices (20, 30).

11. Any of the above aspects, characterized in that the base station (10) has at least one shut-off apparatus (10E, 10M) for fluidically connecting the working machine (50J) selectively to one or more cleaning devices (20, 30).

12. Filter apparatus (70) for a base station (10) according to any one of aspects 8 to 11, characterized, in that the filter apparatus (70) has a plurality of connection openings (70E, 70F) for filling the filter apparatus (70).

13. Any of the above aspects, characterized in that the filter apparatus (70) has a plurality of non-return flaps (70G, 70H), wherein each connection opening (70E, 70F) is assigned a non-return flap (70G, 70H).

14. Any of the above aspects, characterized in that the connection openings (70E, 70F) are arranged on different sides of the filter apparatus (70).

15. Any of the above aspects, characterized in that the filter apparatus (70) comprises a partition wall (70J) dividing the filter apparatus (70) into two chambers (70K, 70L), each chamber (70K, 70L) having one of the connection openings (70E, 70F).

| List of reference signs: | |
|---|---|
| 1 | Cleaning System |
| 2 | Wall |
| 3 | Floor |
| 4 | Mobile Device |
| 5 | Central Unit |
| 10 | Base Station |
| 10A | Power Supply Unit |
| 10B | Power Connection |
| 10C | Holder |
| 10D | Flap |
| 10E | (First) Shut-Off Apparatus |
| 10F | Control Device |
| 10J | First Supply Line |

-continued

| List of reference signs: | |
|---|---|
| 10K | Second Supply Line |
| 10L | Suction Line |
| 10M | Second Shut-Off Apparatus |
| 10N | First Sensor |
| 10P | Second Sensor |
| 10Q | Communication Apparatus |
| 10R | Data Processing Apparatus |
| 20 | First Cleaning Device |
| 20A | Accumulator |
| 20B | Electrical Connection |
| 20C | Collection Container |
| 20Q | First Communication Device |
| 30 | Second Cleaning Device |
| 30A | Accumulator |
| 30B | Electrical Connection |
| 30C | Collection Container |
| 30Q | Second Communication Device |
| 40 | Bottom Module |
| 40A | Receiving Space |
| 40B | Foot Part |
| 40C | Rear Wall |
| 40D | Upper Part |
| 40E | Electrical Connection |
| 40F | Fluidic Connection |
| 40G | Container |
| 40H | Filter |
| 40J | Working Machine |
| 50 | Head Module |
| 50A | Housing |
| 50C | Front Side |
| 50E | Electrical Connection |
| 50F | Fluidic Connection |
| 50G | Container |
| 50H | Filter |
| 50J | Working Machine |
| 50K | Holder |
| 50L | First Holding Part |
| 50M | Second Holding Part |
| 70 | Filter Apparatus |
| 70A | First Connecting Part |
| 70B | Second Connecting Part |
| 70C | Filter Element |
| 70D | Filter Compartment |
| 70E | First Connection Opening |
| 70F | Second Connection Opening |
| 70G | First Non-Return Flap |
| 70H | Second Non-Return Flap |
| 70J | Partition Wall |
| 70K | First Filter Chamber |
| 70L | Second Filter Chamber |
| A | Main Axis |

The invention claimed is:

1. A method to operate a cleaning system with a plurality of mobile cleaning devices and a base station for the cleaning devices comprising:

emptying the cleaning devices or filling the cleaning devices with a cleaning agent by the base station in accordance with a prioritization, wherein emptying or filling of a first cleaning device is interrupted when a second cleaning device is connected to the base station.

2. The method according to claim 1, with at least one of the first cleaning device being emptied or filled by the base station subordinated or the second cleaning device being emptied or filled by the base station with priority.

3. The method according to claim 1, wherein emptying or filling of the first cleaning device is started or continued when the second cleaning device has been completely emptied or filled or is in use.

4. The method according to claim 1, wherein emptying or filling of the first cleaning device is only started when the second cleaning device is removed from the base station.

5. The method according to claim 1, further comprising the base station detecting whether at least one of the first cleaning device or the second cleaning device is connected to the base station.

6. The method according to claim 1, further comprising controlling a shut-off apparatus of the base station to prioritize a cleaning device that is fluidically connected to the base station before a subordinate cleaning device.

7. The method according to claim 6, wherein the shut-off apparatus is a shut-off flap or a butterfly valve.

8. The method according to claim 1, wherein the first cleaning device of the plurality of mobile cleaning devices is a cleaning robot.

9. The method according to claim 1, wherein the second cleaning device of the plurality of mobile cleaning devices is a hand-guided cleaning device.

10. A method to operate a cleaning system with a plurality of mobile cleaning devices and a base station for the cleaning devices comprising:

emptying the cleaning devices or filling the cleaning devices with a cleaning agent by the base station in accordance with a prioritization, wherein emptying or filling of a first cleaning device is only started when a second cleaning device is removed from the base station.

11. The method according to claim 10, with at least one of the first cleaning device being emptied or filled by the base station subordinated or the second cleaning device being emptied or filled by the base station with priority.

12. The method according to claim 10, wherein emptying or filling of the first cleaning device is interrupted when the second cleaning device is connected to the base station.

13. The method according to claim 10, wherein emptying or filling of the first cleaning device is started or continued when the second cleaning device has been completely emptied or filled or is in use.

14. The method according to claim 10, further comprising the base station detecting whether at least one of the first cleaning device or the second cleaning device is connected to the base station.

15. The method according to claim 10, further comprising controlling a shut-off apparatus of the base station to prioritize a cleaning device that is fluidically connected to the base station before a subordinate cleaning device.

16. The method according to claim 15, wherein the shut-off apparatus is a shut-off flap or a butterfly valve.

17. The method according to claim 10, wherein the first cleaning device of the plurality of mobile cleaning devices is a cleaning robot.

18. The method according to claim 10, wherein the second cleaning device of the plurality of mobile cleaning devices is a hand-guided cleaning device.

* * * * *